United States Patent [19]

Hutton

[11] 4,059,141

[45] Nov. 22, 1977

[54] INTRUSION BARRIER AND GUIDE FOR SLIDING WINDOWS, DOORS AND THE LIKE

[76] Inventor: James L. Hutton, P.O. Box 1282, Victorville, Calif. 92392

[21] Appl. No.: 731,856

[22] Filed: Oct. 12, 1976

[51] Int. Cl.[2] ..... E06B 9/01

[52] U.S. Cl. ..... 160/90; 160/102

[58] Field of Search ..... 160/90, 91, 102, 136, 160/137-149; 292/57, 60, 62, DIG. 48

[56] References Cited

U.S. PATENT DOCUMENTS

| | | | |
|---|---|---|---|
| 766,262 | 8/1904 | Johnston | 160/102 |
| 993,654 | 5/1911 | Conant | 160/102 |
| 1,209,529 | 12/1916 | Wilson | 292/57 |
| 1,559,898 | 11/1925 | Lotz | 292/DIG. 48 |
| 1,908,919 | 5/1933 | Reed | 160/102 |

*Primary Examiner*—Peter M. Caun
*Attorney, Agent, or Firm*—John H. Crowe

[57] ABSTRACT

A barrier for barring the opening of a sliding window, door, etc., from intrusion from the exterior of a building or vehicle, the barrier being collapsible to permit escape of persons from the inside of the building or vehicle through the open window in the event of fire or other emergency. The barrier also constrains the window or door to move in a straight line parallel motion to prevent binding or sticking of the same in its slide bearings during opening or closing of the window or door.

2 Claims, 6 Drawing Figures

FIG. 3.
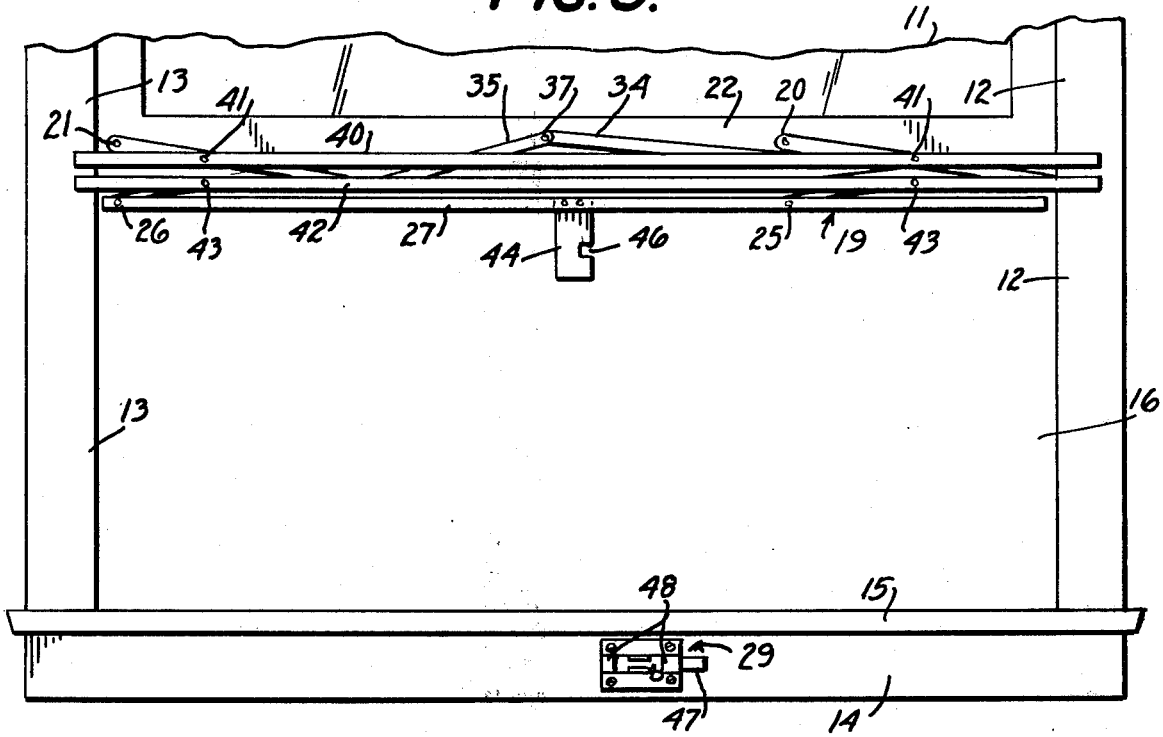
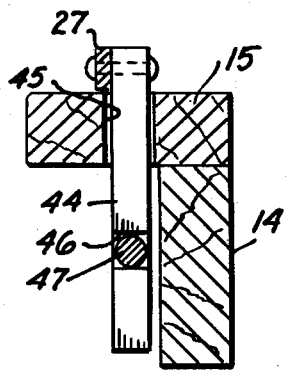
FIG. 4.
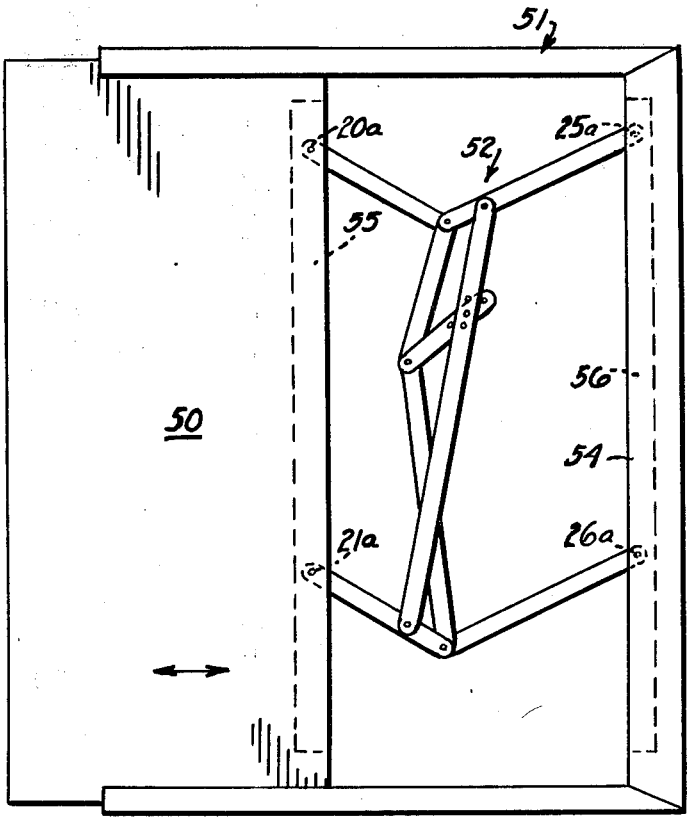
FIG. 5.

INTRUSION BARRIER AND GUIDE FOR SLIDING WINDOWS, DOORS AND THE LIKE

BACKGROUND OF THE INVENTION

1. Field of the Invention

This invention relates to combined barriers and guide means for sliding windows, doors or other closure members to prevent unauthorized intrusion into a building or vehicle through a sliding window or door opening and to aid in guiding the same.

2. Description of the Prior Art

Barriers, such as crossbars secured at spaced intervals across sliding windows, have long been used to prevent entrance of burglars or other intruders into a building through the window openings when such windows are opened. Such barriers, although effective, tend to obstruct the view through such a window and, more importantly, prevent escape of a person through the window opening from inside the building in the event of a fire or other emergency.

SUMMARY OF THE INVENTION

A principal object of the present invention is to provide a barrier to prevent intrusion through the opening of a sliding window or other closure member from the exterior of a building while permitting an unobstructed view through such window.

Another object is to provide a barrier to prevent intrusion through the opening of a window or other closure member of the above type from the exterior while permitting ready exit through such opening from the interior.

Another object is to provide a barrier of the above type which is hidden from view from the outside when the window is closed.

A further object is to provide a barrier of the above type for a sliding window door or the like which also prevents binding or sticking of the window or door in its slide bearings during movement between open and closed positions.

A still further object is to provide a simple, compact and inexpensive barrier for a sliding window or the like.

BRIEF DESCRIPTION OF THE DRAWINGS

The manner in which the above and other objects of the invention are accomplished will be readily understood on reference to the following specification when read in conjunction with the accompanying drawings, wherein:

FIG. 3 is a view similar to FIG. 1 but showing the window in open condition, and the barrier in open condition.

FIG. 4 is a transverse sectional view taken along the line 4—4 of FIG. 1.

FIG. 5 is a front view illustrating a modified form of the invention.

DESCRIPTION OF THE PREFERRED EMBODIMENT

Referring to FIGS. 1 to 4 in particular, the embodiment of the present invention is shown therein as applied to a window 11 which is slidably mounted for vertical movement in a frame comprising side frame members 12 and 13 attached to a suitable top frame member, not shown, and to a combined cross frame member 14 and sill 15, the latter being suitably secured to the upper edge of the member 14. The frame members 12, 13 and 14 may be mounted in a window opening formed in a building or vehicle side wall in the usual manner. The side frame members 12 and 13 form slide bearings for guiding the window vertically.

Figure 1:
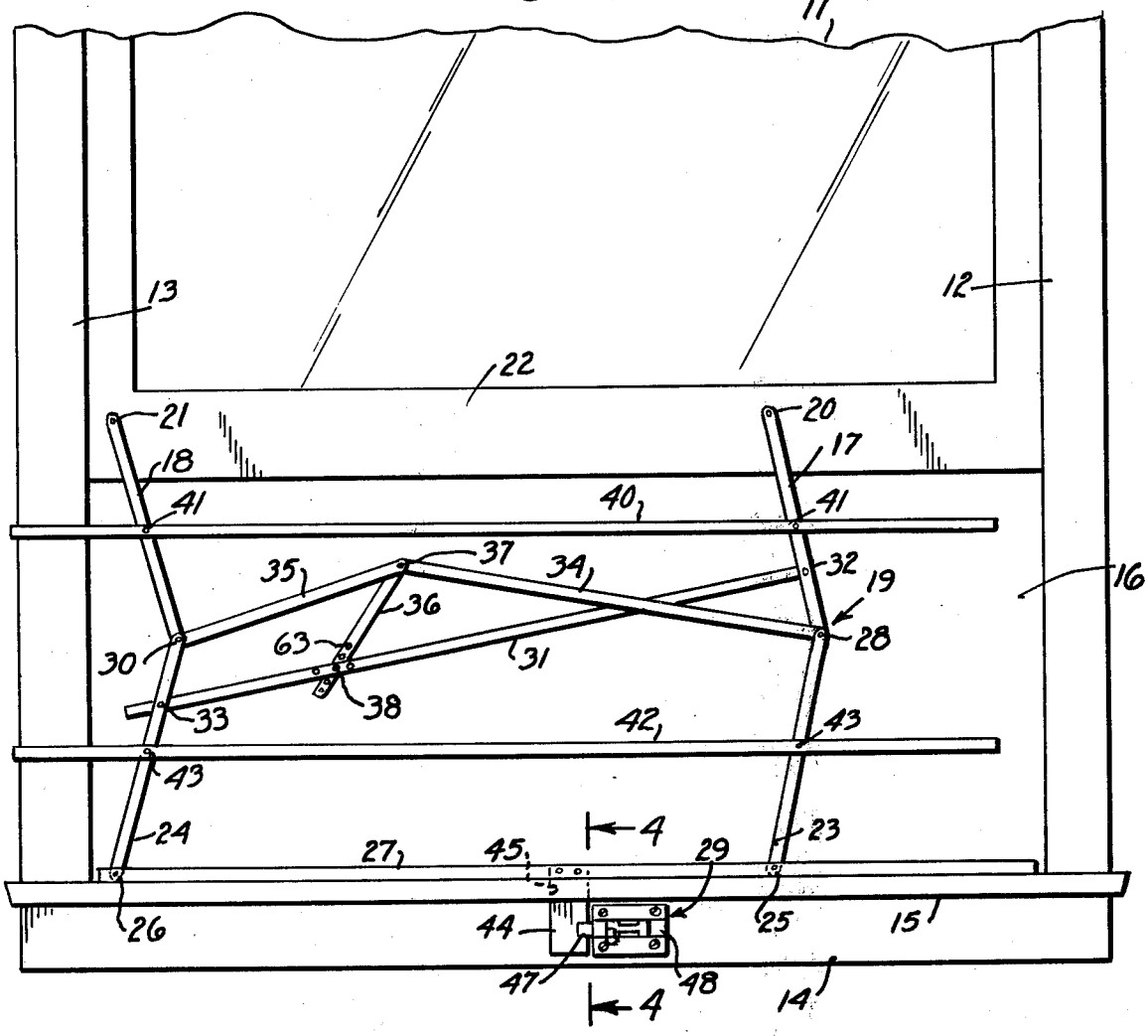
FIG. 1 is a front view of sliding window and its frame when viewed from the inside of a building or vehicle, embodying a preferred form of the present invention, and showing the window in open condition and the barrier in place.
Figure 2:
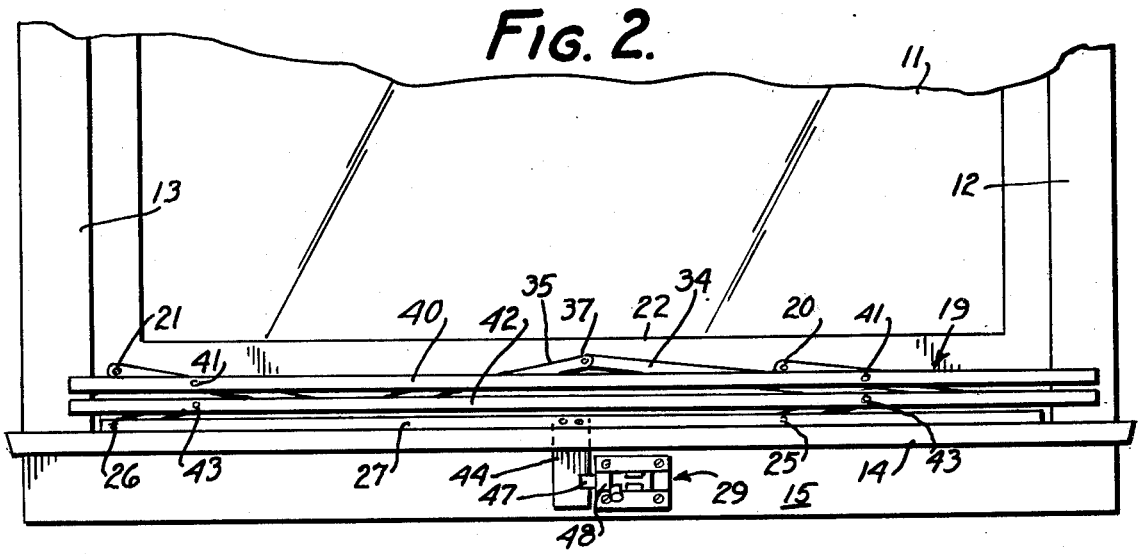
FIG. 2 is a view similar to FIG. 1 but showing the window in closed condition.

The window 11 is movable through a window opening 16 from an open position shown in FIG. 1 to a closed position shown in FIG. 2. Suitable means, not shown, may be provided to maintain the window in its fully open position or fully closed position or in any other position therebetween, and to lock the window in closed position.

According to the present invention, a combined guide and intrusion barrier, generally indicated at 19, is provided to prevent entry through the window opening 16 from the exterior of the building, vehicle or the like, when the window is in open or in partially open position and to aid the slide bearings in guiding the window in a parallel movement during opening or closing movement. The barrier 19 comprises a first pair of parallel links 17 and 18 pivotally connected at 20 and 21 at their upper ends to a lower frame element 22 of the window 11. A second pair of parallel links 23 and 24 are pivotally connected at 25 and 26 at their lower ends to a cross bar 27 and are pivotally connected at 28 and 30 at their upper ends to respective lower ends of the parallel links 17 and 18. Cross bar 27 is normally locked to the sill 15 by a latch, generally indicated at 29, as will be explained later.

A cross or guide link 31 is pivotally connected at 32 to link 17 of the first pair of parallel links and at 33 to the link 24 of the second pair.

It will be noted that the parallel links 17, 18, 23 and 24 are all of the same length and that the distance between the pivots 28 and 32 is the same as the distance between the pivots 30 and 33.

The cross link 31 constrains the parallel links to move in a generally parallel manner. However, due to a non-symmetrical relationship between the parallel links and the cross-link 31, as will be described presently, the link 31 tends to guide the parallel links in a slightly non-parallel movement and this would, in the absence of additional guiding means, tend to allow binding of the window in its slide bearings. Accordingly, an equalizer linkage is provided comprising additional links 34, 35 and 36, all pivotally connected together at adjacent ends at 37. The link 36 is pivotally connected at its opposite end to cross link 31 at 38. Link 34 is pivotally connected at its opposite end at 28 to links 17 and 23, and link 35 is pivotally connected at its opposite end at 30 to the links 18 and 24.

It should be noted here that each of the pivots 20, 21, 25, 26, 28, 30, 32, 33, 37 and 38 comprises a suitable pin (not shown) freely pivotal in a bearing hole formed in a respective one or ones of the connected links and therefore a minute clearance exists between each pin and its associated bearing.

Figure 6:
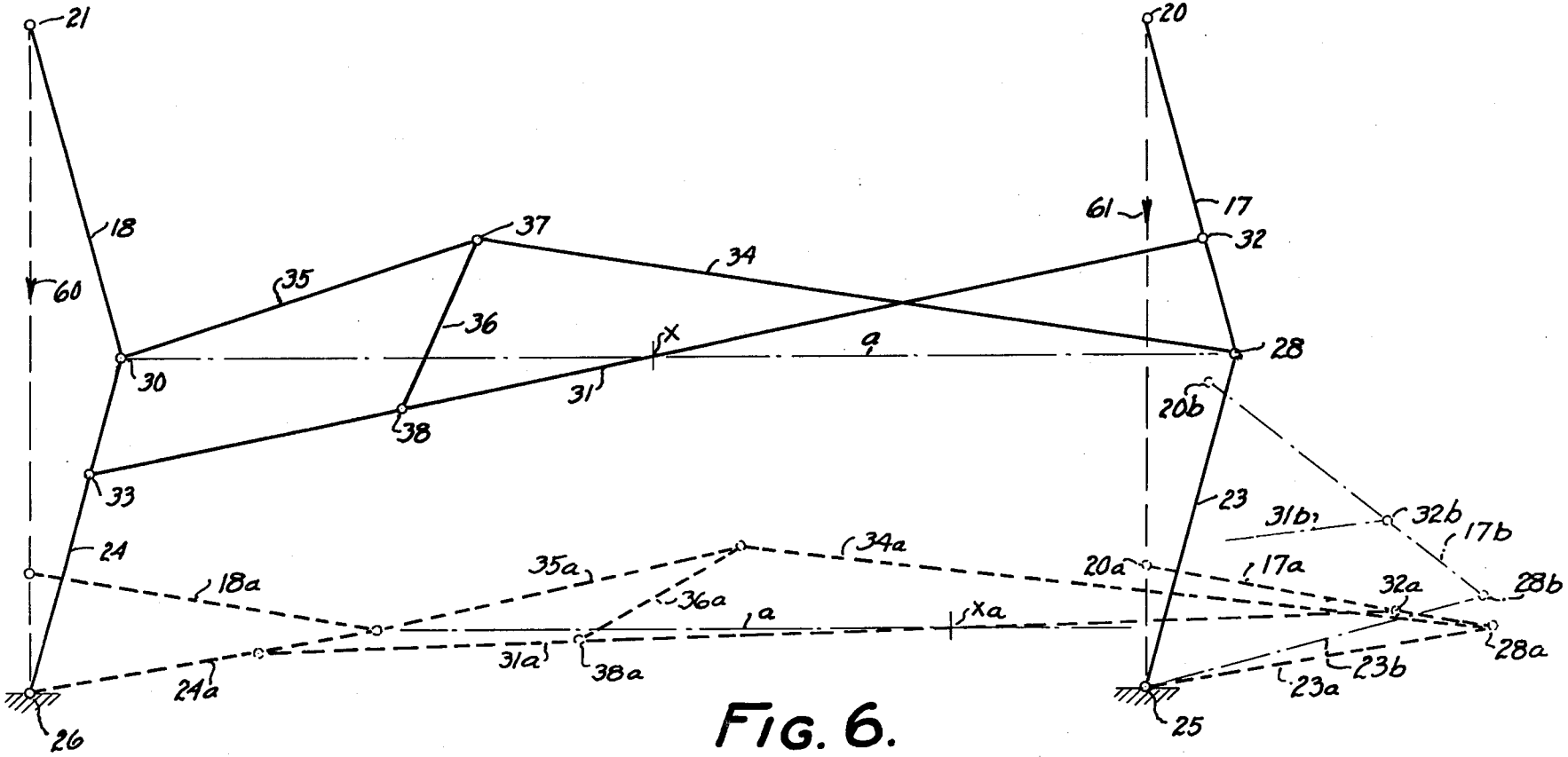
FIG. 6 is a diagramatic view illustrating the operation of the linkage comprising the combined guide and barrier.

FIG. 6 diagramatically illustrates the relationship of the various links in both the open and substantially closed position of the window. The full lines illustrate the position of the links with the window open, as depicted in FIG. 1, and the dotted lines illustrate the positions of the links when the window is substantially closed.

Describing now the operation of the various links, as the window is moved downward toward its closed position, the link pairs 17, 23 and 18, 24 collapse toward their alternate dotted line positions 17*a*, 23*a*, and 18*a*, 24*a*. As noted above, an unsymmetrical relationship exists between the links, as evidenced by the fact that the point of intersection "*x*" between cross link 31 and a center line "*a*" passing through pivots 28 and 30 shifts to the right toward point "$x_a$" as the window is closed. Therefore, assuming that the pivot 21, connecting link 18 to the left end of the window 11, is constrained to move in a vertical path 60, and in the absence of the equalizing links 34, 35, and 36, the cross link 31 would tend to force the links 17 and 23 into their dot-dash line positions 17*b* and 23*b*, thereby tending to move the pivot 20, connecting the link 17 to the right hand of the window 11, upwardly relative to the pivot 21 and out of the intended path 61, resulting in a tendency to allow the window to bind in its slide bearings. Links 34, 35 and 36 counteract this tendency and force links 17 and 23 to move in parallel relation to links 18 and 24. That is, as the link pairs collapse, link 35 causes link 36 to turn clockwise about its pivot 38, causing link 34 to exert a controlling force on the pivot 28, thereby constraining link 23 to follow about pivot 25. Link 17, pivotally connected to link 31 is constrained to follow in substantially parallel relation with link 18.

The location of pivot 38 may be changed somewhat to correct for minor errors in dimensions between various pivots, and for this purpose, spaced pivot bearing holes 63 are provided along link 36 so that the pivot pin (not shown) forming pivot 38 may be inserted in any combination of such bearing holes to effectively change the position of pivot 38.

A bar 40 is pivotally connected at 41 to the parallel links 17 and 18 midway between their ends. Likewise, a second bar 42 is pivotally connected at 43 to the parallel links 23 and 24 midway between their ends. Such bars 40 and 42 thus extend parallel to the cross bar 27 and move in a parallel manner during opening and closing of the window 11 to cooperate with the cross link 31 to prevent intrusion through the window opening 16. Equalizer links 34, 35 and 36 also contribute in barring the window opening.

As will be seen in FIG. 2, when the window is closed, the bars 40 and 42 nest next to each other and behind the window frame member 22 so as to be hidden from view from the exterior of the building or vehicle.

The cross bar 27 is normally attached on top of the sill 15 and for this purpose a depending latch tongue 44 is suitably secured to the latch bar intermediate the ends thereof. Normally, the tongue 44 extends through a close fitting opening 45 in the sill, as shown in FIG. 4, and has a notch 46 therein engaged by a latch bolt 47 of the latch 29. Bolt 47 is slidable in a slide bearing 48 secured to the bottom frame member 14 of the window frame. Thus, the latch 29 is hidden from view from the exterior of the window and cannot be seen by a would-be intruder. However, in the event of a fire or other emergency, the latch would be readily visible to anyone within the building and the bolt 47 may be readily slid back to release the tongue 44, permitting the barrier 17 to be collasped upwardly into its position shown in FIG. 3 to permit escape through the window opening 16.

FIG. 5 illustrates a modified form of the invention as applied to a door or window 50 which is slideable horizontally within a frame 51 for movement between open and closed positions. A linkage generally indicated at 52, and generally similar to linkage 19, except for the omission of parallel bars 40 and 41, is provided principally to assist the slide bearings provided by the frame 51 in enforcing a straight line parallel movement of the member 50. In this case, cross bar 27 is omitted. Also, pivots 25*a* and 26*a*, similar to pivots 25 and 26, are mounted directly on a frame member 54 forming part of the frame 51. Pivots 20*a* and 21*a*, similar to pivots 20 and 21, are mounted on the door 50.

It will be noted that the pivots 20*a* and 21*a* are located within an elongate slot 55 formed in the edge of the door 50. Also, the pivots 25*a* and 26*a* are likewise located within an elongate slot 56 formed in the edge of the frame member 54. Thus, when the door 50 is moved fully to the right, the collapsed linkage 52 will be contained within such slots 55 and 56 and will thus be substantially hidden from view from both sides of the door.

In cases where the door frame 51 is fitted within a hollow wall, the linkage 52 will be hidden from view at all times.

It will obvious to those skilled in the art that many variations may be made in the exact structure shown without departing from the spirit of this invention.

I claim:

1. A device for association with a closure member, said closure member being slideable across an opening in a frame, comprising a cross member on the side of said opening opposite said closure member, a first pair of spaced parallel links pivotally connected at ones of their ends to said closure member, a second pair of spaced parallel links pivotally connected at ones of their ends to said cross member, one of said parallel links of the links of said first pair being pivotally connected at their opposite ends to the opposite ends of respective ones of the links of said second pair, and enforcing means for enforcing parallel swinging movement of the parallel links of each of the pairs upon sliding movement of said closure member, said enforcing means comprising:

a cross link pivotally connected between one of said parallel links of one of said pairs and one of said parallel links of the other of said pairs, a pair of equalizer links pivotally connected together at ones of their ends and pivotally connected at the opposite ends thereof to respective ones of said opposite ends of said links of said first and second pairs, and a third equalizer link pivotally connected at one end to said cross link and pivotally connected at the opposite end thereof to the pivotal connection between said pair of equalizer links.

2. A device as defined in claim 1 wherein said pivotal connection for said one end of said third equalizer link lies intermediate the pivotal connections between said cross link and said parallel links.

* * * * *